US009689359B2

(12) United States Patent
Schuerz

(10) Patent No.: US 9,689,359 B2
(45) **Date of Patent: *Jun. 27, 2017**

(54) PIEZO INJECTOR

(71) Applicant: Continental Automotive GmbH, Hannover (DE)

(72) Inventor: Willibald Schuerz, Pielenhofen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 0 days.

This patent is subject to a terminal disclaimer.

(21) Appl. No.: 14/653,334

(22) PCT Filed: Dec. 17, 2013

(86) PCT No.: PCT/EP2013/076961

§ 371 (c)(1),
(2) Date: Jun. 18, 2015

(87) PCT Pub. No.: WO2014/095910

PCT Pub. Date: Jun. 26, 2014

(65) Prior Publication Data

US 2015/0345443 A1 Dec. 3, 2015

(30) Foreign Application Priority Data

Dec. 20, 2012 (DE) ..... 10 2012 223 934

(51) Int. Cl.
*B05B 1/08* (2006.01)
*F02M 51/06* (2006.01)
(Continued)

(52) U.S. Cl.
CPC ..... *F02M 51/0603* (2013.01); *B05B 1/3046* (2013.01); *B05B 17/0607* (2013.01);
(Continued)

(58) Field of Classification Search
CPC ..... F02M 51/0603; F02M 2200/704; F02M 2200/705; F02M 2200/708;
(Continued)

(56) References Cited

U.S. PATENT DOCUMENTS 6,196,472 B1 * 3/2001 Cooke ..... F02M 51/0603 239/102.2
6,427,968 B1 8/2002 Stoecklein ..... 251/57
(Continued)

FOREIGN PATENT DOCUMENTS

AT 500889 A1 4/2006 ..... F02M 47/02
CN 1712696 A 12/2005 ..... F02M 61/16
(Continued)

OTHER PUBLICATIONS

International Search Report and Written Opinion, Application No. PCT/EP2013/076961, 18 pages, Mar. 28, 2014.
(Continued)

*Primary Examiner* — Steven J Ganey
(74) *Attorney, Agent, or Firm* — Slayden Grubert Beard PLLC

(57) ABSTRACT

A piezo injector with an actuator chamber, in which a piezo actuator is arranged, includes an upper section (the injector body) and a lower section (the nozzle body). The piezo injector also has a control piston bore formed in the nozzle body, wherein a control sleeve, in which a control piston is received, is arranged in the control piston bore. The control sleeve seals against an intermediate plate with a first front face facing the piezo actuator. The control piston has a first side facing the piezo actuator, wherein the first front face of the control piston and the section of the control sleeve facing the piezo actuator form a first control chamber.

14 Claims, 2 Drawing Sheets

(51) Int. Cl.
*F02M 57/02* (2006.01)
*B05B 17/06* (2006.01)
*B05B 1/30* (2006.01)
*F02M 47/02* (2006.01)

(52) U.S. Cl.
CPC ..... *F02M 47/02* (2013.01); *F02M 57/02* (2013.01); *F02M 2200/704* (2013.01); *F02M 2200/705* (2013.01); *F02M 2200/708* (2013.01); *F02M 2547/001* (2013.01)

(58) Field of Classification Search
CPC .. F02M 2547/001; F02M 57/02; F02M 47/02; B05B 17/0607; B05B 1/3046
USPC ..... 239/102.2, 88, 96, 584; 123/498
See application file for complete search history.

(56) References Cited

U.S. PATENT DOCUMENTS

| | | | | |
|---|---|---|---|---|
| 7,258,283 | B2 * | 8/2007 | Heinz | F02M 51/0603 239/102.2 |
| 7,309,027 | B2 * | 12/2007 | Magel | F02M 61/167 239/102.2 |
| 7,455,244 | B2 | 11/2008 | Boecking | 239/102.2 |
| 7,926,737 | B2 | 4/2011 | Stoecklein et al. | 239/96 |
| 8,875,566 | B2 | 11/2014 | Hoffmann et al. | 73/114.45 |
| 9,121,378 | B2 | 9/2015 | Katzenberger et al. | |
| 9,133,805 | B2 | 9/2015 | Uhlmann | |
| 2004/0144868 | A1 | 7/2004 | Yoshimura et al. | 239/533.2 |
| 2006/0032940 | A1 | 2/2006 | Boecking | 239/88 |
| 2006/0186221 | A1 | 8/2006 | Heinz et al. | 239/88 |
| 2006/0289681 | A1 | 12/2006 | Boecking | 239/533.3 |
| 2008/0053410 | A1 | 3/2008 | Gant | 123/472 |
| 2009/0065614 | A1 | 3/2009 | Ganser | 239/584 |
| 2009/0205614 | A1 | 8/2009 | Hlousek et al. | 123/476 |
| 2009/0266340 | A1 | 10/2009 | Eisenmenger et al. | 123/494 |
| 2012/0152206 | A1 | 6/2012 | Adachi et al. | 123/445 |
| 2014/0251276 | A1 | 9/2014 | Schürz | 123/456 |
| 2015/0184627 | A1 * | 7/2015 | Schuerz | F02M 63/0026 239/102.2 |
| 2015/0292462 | A1 * | 10/2015 | Jagani | F02M 63/0026 239/102.2 |

FOREIGN PATENT DOCUMENTS

| | | | | |
|---|---|---|---|---|
| CN | 101331312 | A | 12/2008 | F02M 47/02 |
| CN | 102483018 | A | 5/2012 | F02M 47/02 |
| DE | 10326045 | A1 | 12/2004 | F02M 45/08 |
| DE | 10326046 | A1 | 12/2004 | F02M 47/00 |
| DE | 102004054589 | A1 | 5/2006 | F02M 47/00 |
| DE | 102005030137 | A1 | 1/2007 | F02M 51/06 |
| DE | 102006011293 | A1 | 9/2007 | H01L 41/083 |
| DE | 102007006941 | A1 | 8/2008 | F02M 47/02 |
| DE | 102007051554 | A1 | 4/2009 | F02M 47/02 |
| DE | 102008002416 | A1 | 12/2009 | F02M 51/06 |
| DE | 102009002554 | A1 | 1/2010 | F02M 47/02 |
| DE | 102009039647 | A1 | 3/2011 | F02M 47/02 |
| DE | 102011056406 | A1 | 6/2012 | F02M 47/02 |
| DE | 102011003443 | A1 | 8/2012 | F02M 51/06 |
| EP | 0477400 | A1 | 4/1992 | F02M 51/06 |
| EP | 1433952 | A2 | 6/2004 | F02M 47/00 |
| EP | 1508690 | A1 | 2/2005 | F02M 51/06 |
| EP | 1508690 | B1 | 10/2006 | F02M 51/06 |
| EP | 1840366 | A2 | 10/2007 | F02M 51/06 |
| EP | 1983186 | A2 | 10/2008 | F02M 47/02 |
| EP | 2511514 | A2 | 10/2012 | F02M 47/02 |
| GB | 2296940 | A | 7/1996 | F02M 21/02 |
| WO | 01/23741 | A1 | 4/2001 | F02M 45/04 |
| WO | 2003/064847 | A1 | 8/2003 | F02M 51/06 |
| WO | 2005/019637 | A1 | 3/2005 | F02M 45/08 |
| WO | 2005/075811 | A1 | 8/2005 | F02M 51/06 |
| WO | 2007/098621 | A1 | 9/2007 | F02M 47/02 |
| WO | 2012/113796 | A1 | 8/2012 | F02D 41/20 |
| WO | 2012/126736 | A1 | 9/2012 | F02D 41/20 |
| WO | 2013/010929 | A1 | 1/2013 | F02M 51/06 |
| WO | 2014/012795 | A1 | 1/2014 | F02M 61/16 |
| WO | 2014/086933 | A1 | 6/2014 | F02M 47/02 |
| WO | 2014/095910 | A1 | 6/2014 | F02M 51/06 |

OTHER PUBLICATIONS

U.S. Final Office Action, U.S. Appl. No. 14/234,039, 15 pages, Jul. 1, 2016.
International Search Report and Preliminary Report on Patentability, Application No. PCT/EP2012/063753, 9 pages, Dec. 12, 2012.
International Search Report and Written Opinion, Application No. PCT/EP2013/064111, 15 pages, Sep. 9, 2013.
International Search Report and Written Opinion, Application No. PCT/EP2013/075693, 17 pages, Apr. 3, 2014.
U.S. Non-Final Office Action, U.S. Appl. No. 14/234,039, 16 pages, Jan. 15, 2016.
U.S. Non-Final Office Action, U.S. Appl. No. 14/649,997, 12 pages, Apr. 7, 2016.
Chinese Office Action, Application No. 201380063761.5, 12 pages, Oct. 8, 2016.
U.S. Advisory Action, U.S. Appl. No. 14/234,039, 3 pages, Nov. 4, 2016.
Chinese Office Action, Application No. 201380062531.7, 14 pages, Oct. 6, 2016.
U.S. Non-Final Office Action, U.S. Appl. No. 14/234,039, 32 pages, Feb. 9, 2017.
U.S. Final Office Action, U.S. Appl. No. 14/649,997, 16 pages, Dec. 2, 2016.

* cited by examiner

PIEZO INJECTOR

CROSS-REFERENCE TO RELATED APPLICATIONS

This application is a U.S. National Stage Application of International Application No. PCT/EP2013/076961 filed Dec. 17, 2013, which designates the United States of America, and claims priority to DE Application No. 10 2012 223 934.0 filed Dec. 20, 2012, the contents of which are hereby incorporated by reference in their entirety.

TECHNICAL FIELD

The invention relates to a piezo injector.

BACKGROUND

Internal combustion engines with direct fuel injection are known. For the direct fuel injection, use is made of injection valves, for example piezo injectors, the nozzle needle of which is driven by means of a piezo actuator. Here, a hydraulic transmitter unit is provided between the actuator and the nozzle needle. The deflection of the actuator is converted into a corresponding deflection of the nozzle needle. For this purpose, virtually play-free coupling is necessary between the piezo actuator and the nozzle needle. Such play-free coupling is however difficult to maintain owing to thermally induced changes in length in the piezo injector. If the idle stroke between piezo actuator and nozzle needle is too small, this can result in incomplete closure of the nozzle needle. If the idle stroke between piezo actuator and the nozzle needle is too large, this leads to an increase in the actuation energy required for actuating the piezo injector. From the prior art, it is known for thermally induced changes in length to be compensated by way of a suitable material selection and geometry. This however leads to high manufacturing costs and greatly restricts the structural freedom in the design of the piezo injector.

SUMMARY

One embodiment provides a piezo injector, comprising: an actuator chamber; a piezo actuator arranged in the actuator chamber, an upper section, the injector body, and a lower section, the nozzle body, having a control piston bore which is formed in the nozzle body, wherein a control sleeve is arranged in the control piston bore, in which control sleeve there is accommodated a control piston, wherein the control sleeve, by way of a first face side facing toward the piezo actuator, sealingly adjoins an intermediate plate, wherein the control piston has a first face side facing toward the piezo actuator, wherein the first face side of the control piston and that section of the control sleeve which faces toward the piezo actuator form a first control chamber, having a nozzle needle with a second face side, wherein the nozzle needle is guided displaceably in a central, cylindrical bore in the control piston, wherein the central bore in the control piston and the second face side of the nozzle needle form a second control chamber, having at least one connecting bore between the first control chamber and the second control chamber, which at least one connecting bore is provided in the control piston so as to transmit a change in pressure between the first and the second control chamber, and having a leakage pin which is arranged between the piezo actuator and the first face side of the control piston in a leakage pin bore in the intermediate plate and which transmits an actuator stroke directly to the control piston, wherein a spring chamber is provided at that end of the control piston and of the control sleeve which faces away from the first control chamber.

In a further embodiment, a first leakage out of the first control chamber is permitted, a second leakage out of a high-pressure region into the first control chamber is permitted, a third leakage out of the high-pressure region into the second control chamber is permitted, the sum of the second leakage and the third leakage is at least as great as the first leakage, and the sum of the second leakage and the third leakage is so small that, when the nozzle needle is open, a pressure increase effected in the second control chamber by the second and the third leakage does not lead to a closure of the nozzle needle.

In a further embodiment, the piezo injector has a high-pressure bore, wherein the high-pressure bore is connected to the high-pressure region, wherein the high-pressure region is connected to the spring chamber.

In a further embodiment, in the spring chamber, there is arranged a control piston spring which forces the control piston into abutment against the leakage pin with a force which acts in the direction of the first control chamber.

In a further embodiment, in the spring chamber, there is arranged a control sleeve spring which forces the control sleeve into abutment against the intermediate plate.

In a further embodiment, there is a first pairing clearance between the leakage pin and the leakage pin bore, wherein the first pairing clearance permits the first leakage, wherein the first pairing clearance is less than two μm.

In a further embodiment, there is a second pairing clearance between the control piston and the control sleeve, the second pairing clearance permits the second leakage, and the second pairing clearance is between four and eight μm.

In a further embodiment, there is a third pairing clearance between the nozzle needle and the control piston, the third pairing clearance permits the third leakage, wherein the third pairing clearance is between two and eight μm.

In a further embodiment, the piezo actuator is in the form of a fully active piezo stack.

BRIEF DESCRIPTION OF THE DRAWINGS

Example embodiments of the invention are discussed in more detail below with reference to the figures, in which.

DETAILED DESCRIPTION

Figure 1:
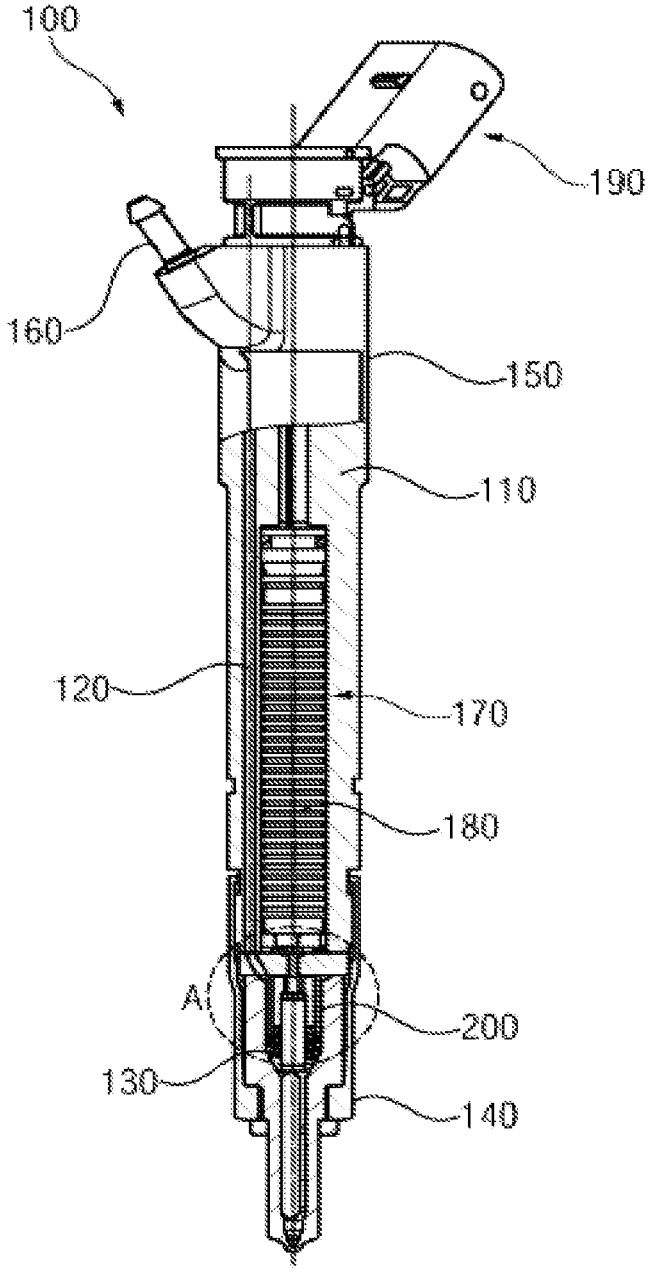
FIG. 1 shows a partial section view of a piezo injector according to an embodiment of the invention having a hydraulic direct drive, which is integrated into the nozzle, of the nozzle needle.
Figure 2:
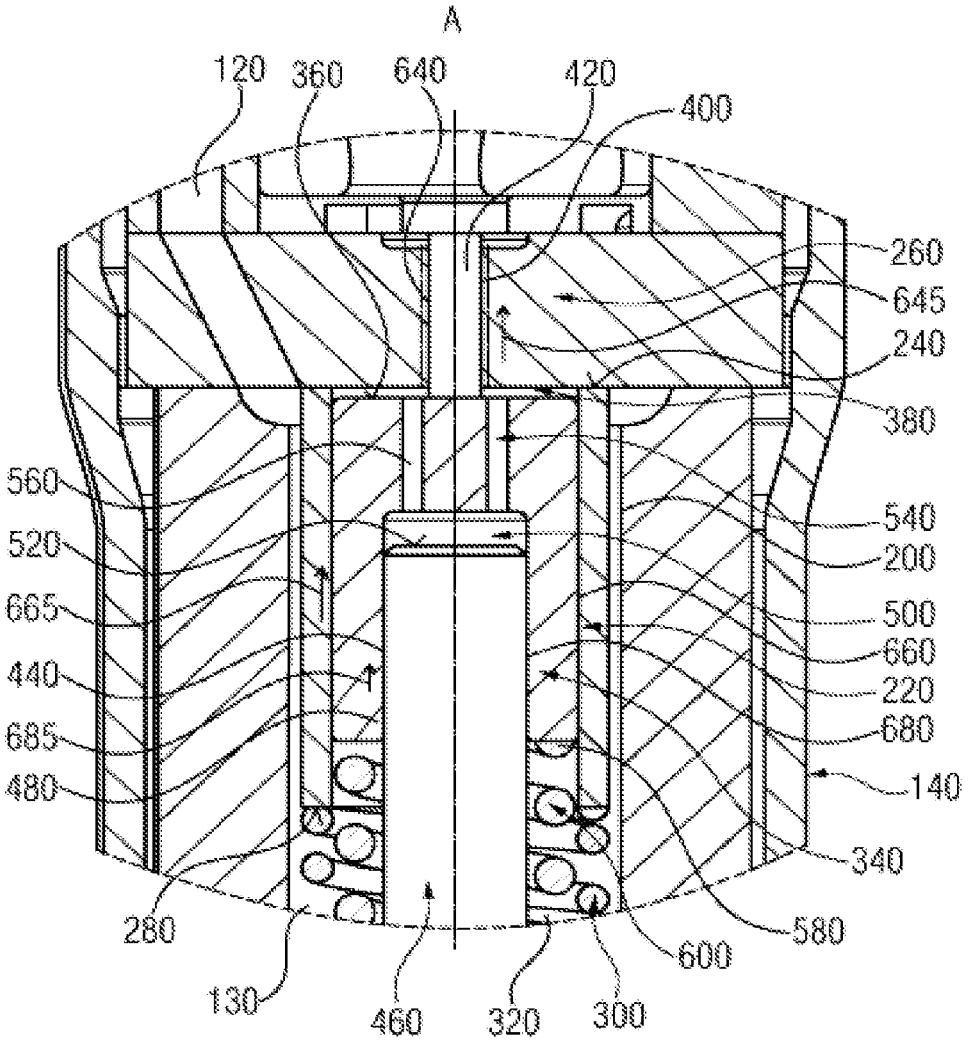
FIG. 2 shows an enlarged view of the detail A from FIG. 1, specifically a sectional view through the control part of the hydraulic direct drive, which is integrated into the nozzle, of the nozzle needle.

Embodiments of the present invention provide a piezo injector in the case of which changes in length of the piezo injector are automatically compensated and which is characterized by a compact construction which is simple to produce.

Some embodiments provide a piezo injector having an actuator chamber in which a piezo actuator is arranged, a control piston bore in which a control sleeve is arranged, in which control sleeve there is accommodated a control piston, wherein the control sleeve, by way of its face side facing toward the piezo actuator, sealingly adjoins an intermediate plate, wherein the control piston has a first face side facing toward the piezo actuator, wherein the first face side of the control piston and that section of the control sleeve which faces toward the piezo actuator form a first control chamber. Furthermore, the piezo injector comprises a nozzle needle with a second face side, wherein the nozzle needle is guided displaceably in a central, cylindrical bore in the control piston, wherein the central bore in the control piston and the second face side of the nozzle needle form a second control chamber, and furthermore at least one connecting bore between the first control chamber and the second control chamber, which at least one connecting bore is provided in the control piston so as to transmit a change in pressure between the first and the second control chamber. Also, said piezo injector comprises a leakage pin which is arranged between the piezo actuator and the first face side of the control piston in a leakage pin bore in the intermediate plate and which transmits an actuator stroke directly to the control piston, wherein a spring chamber is provided at that end of the control piston and of the control sleeve which faces away from the first control chamber.

In said piezo injector, there is advantageously a hydraulic coupling between the piezo actuator and the nozzle needle, which hydraulic coupling is integrated into the nozzle. Said hydraulic coupling advantageously effects play compensation and stroke transmission. In this way, temperature effects, wear at contact points in the drive and changes in length in the piezo injector caused by changes in the state of polarization of the piezo actuator can be compensated. This advantageously makes it possible for the injector to be manufactured from any desired material, without the need to take into consideration thermal expansion characteristics of the material. It is therefore possible to use a material which is particularly resistant to high pressure. It is advantageously the case that, during the assembly of the piezo injector, cumbersome setting processes for the idle stroke are dispensed with, reducing the manufacturing costs for the piezo injector. Owing to the elimination of an idle stroke, the energy required for the actuation of the piezo injector is also reduced. A further advantage of the piezo injector is an improved injection quantity stability in dynamic engine operation. It is likewise advantageous that the pressure loss in the piezo injector is reduced in relation to the prior art.

It is expedient for a first leakage out of the first control chamber to be permitted, for a second leakage out of a high-pressure region into the first control chamber to be permitted, and for a third leakage out of the high-pressure region into the second control chamber to be permitted. In this case, the sum of the second leakage and the third leakage is at least as great as the first leakage, and the sum of the second leakage and the third leakage is so small that, when the nozzle needle opens, a pressure increase effected in the second control chamber by the second and the third leakage does not lead to a closure of the nozzle needle. The second and the third leakage advantageously prevent the first leakage from effecting an inadvertent opening of the nozzle needle. The second and the third leakage advantageously also prevent an undesired opening of the nozzle needle in the presence of very steep pressure gradients in the high-pressure region.

The piezo injector may have a high-pressure bore which is connected to the high-pressure region. In this case, the high-pressure region is connected to the spring chamber. It is then advantageously the case that the high pressure of the high-pressure bore prevails in the spring chamber at all times.

It is expedient if, in the spring chamber, there is arranged a control piston spring which forces the control piston into abutment against the leakage pin with a force which acts in the direction of the first control chamber. The control piston spring advantageously effects a return movement of the control piston into its initial position after an injection process has come to an end.

It is likewise expedient if, in the spring chamber, there is arranged a control sleeve spring which forces the control sleeve into abutment against an intermediate plate. This advantageously results in a sealing connection between the control sleeve and the intermediate plate, whereby the first control chamber is likewise sealed off.

In one embodiment of the piezo injector, there is a first pairing clearance between the leakage pin and the leakage pin bore, which first pairing clearance permits the first leakage. In this case, the first pairing clearance is less than 2 μm. Advantageously, experiments and model calculations have shown that such a first pairing clearance leads to an adequately small first leakage.

In a further embodiment of the piezo injector, there is a second pairing clearance between the control piston and the control sleeve, which second pairing clearance permits the second leakage. Here, too, model calculations and experiments have shown that a second pairing clearance thus dimensioned leads to a second leakage of suitable magnitude.

In one embodiment of the piezo injector, there is a third pairing clearance between the nozzle needle and the control piston, which third pairing clearance permits the third leakage. In this case, the second pairing clearance is between 4 and 8 μm.

It has advantageously been found, in model calculations and experiments, that a third pairing clearance in this range leads to a suitable third leakage.

The piezo actuator may be in the form of a fully active piezo stack. It may advantageously be provided that the piezo actuator is hermetically separated from the fuel, and does not need to exhibit particular resistance to fuel.

FIG. 1 shows partial section view of a piezo injector according to an embodiment of the invention. The piezo injector 100 may serve for the injection of fuel into an internal combustion engine. The piezo injector 100 may for example serve for the injection of diesel fuel in a common-rail internal combustion engine.

The piezo injector 100 has an injector housing 110. The injector housing 110 may be composed of substantially any desired material, as the thermal expansion characteristics of the injector housing 110 are not of importance. In particular, the injector housing 110 need not be composed of Invar steel.

In the injector housing 110 there is arranged a high-pressure bore 120 to which highly pressurized fuel can be fed via a high-pressure port. The high-pressure bore 120 runs in the longitudinal direction through the injector housing 110 to a high-pressure region 130, to be discussed further below, in a lower section 140, the nozzle body, of the piezo injector 100. An upper section 150 of the piezo injector 100, the injector body 150, furthermore has a leakage port 160.

Furthermore, the injector housing 110 has, in the upper section 150 of the piezo injector 100, an actuator chamber 170 in which there is arranged a piezo actuator 180. The piezo actuator 180 is of approximately cylindrical form and can have an electrical voltage applied to it via an electrical connector 190 in order to vary the length of the piezo actuator 180 in the longitudinal direction.

In the lower section, the nozzle body 140, the piezo injector 100 has a control piston bore 200 in which there is arranged a control sleeve 220. The control sleeve 220 has a first face side 240 which points in the direction of the piezo actuator 180. By way of said first face side 240, the control sleeve 220 bears sealingly against an intermediate plate 260. A second face side 280, facing away from the piezo actuator 180, of the control sleeve 220 is acted on by way of a control sleeve spring 300. Said control sleeve spring 300 acts on the control sleeve 220 with a force which forces the control sleeve 220 into sealing contact with the intermediate plate 260. Here, the control sleeve spring 300 is arranged in a spring chamber 320 formed by the control piston bore 200.

A control piston 340 is fitted in the control sleeve 220 with a small clearance of approximately 6 μm. The control piston 340 has a first face side 360 pointing in the direction of the piezo actuator 180. The first face side 360 of the control piston 340, the intermediate plate 260 and the control sleeve 220 form a first control chamber 380.

In the intermediate plate 260 adjoining the control sleeve 220 there is formed a leakage pin bore 400. In said leakage pin bore 400, a leakage pin 420 is fitted between the piezo actuator 180 and the control piston 340 with a very small clearance. The length of the leakage pin 420 is in this case dimensioned such that an increase in the length of the piezo actuator 180 is transmitted via the leakage pin 420 to the first face side 360 of the control piston 340. The leakage pin 420 is in this case fitted in the leakage pin bore 400 with a first pairing clearance 640 of approximately one μm, such that even in the presence of a high rail pressure, an adequately small fuel leakage, first leakage 645, out of the control chamber 380 is possible.

In the control piston 300 there is formed a cylindrical bore 440 by means of which an inner cylinder barrel is provided in the control piston 340. A nozzle needle 460 is, by way of its upper end 480 facing toward the piezo actuator 180, fitted in the cylindrical bore 440 of the control piston 340 with a narrow pairing clearance, third pairing clearance, of approximately 4 μm. A second control chamber 500 is thus formed by the inner cylinder barrel of the cylindrical bore 440 and a first face side 520 of the nozzle needle 460 in the cylindrical bore 440 of the control piston.

In the control piston 340 there are formed two connecting bores 540, 560 which connect the first control chamber 380 and the second control chamber 500. Said connecting bores 540, 560 are designed so as to transmit pressure changes between the first control chamber 380 and the second control chamber 500. It is pointed out that the number of connecting bores 540, 560 is not restricted to two; it is also possible for only one connecting bore or for more than two connecting bores to be provided as long as the pressure transmission between the two control chambers 380 and 500 is ensured.

On that face side 580 of the control piston 340 which is situated opposite the first face side 360 of the control piston 380, there is arranged a further spring 600 which acts on the control piston 340. Said spring 600 acts on the control piston 340 with a force acting in the direction of the first control chamber 380.

The spring 600 is, like the control sleeve spring 300, arranged in the spring chamber 320. Said spring chamber 320 is connected to the high-pressure region 130. Thus, fuel with the pressure prevailing in the high-pressure bore 120 and in the high-pressure region 130 is always situated in the spring chamber 320 during operation of the piezo injector 100.

Furthermore, the lower section 140 of the piezo injector 100 has arranged in it the high-pressure region 130, in which the high-pressure bore 120 opens out. Arranged in the high-pressure region 130 is the nozzle needle 460, the upper end 480 of which is guided in the cylindrical bore 440, as described above.

In the closed state of the piezo injector 100, the nozzle needle 460 bears against a lower tip of the lower section 140 of the piezo injector. The piezo actuator 180 is discharged and exhibits its minimum length. The piezo injector 100 does not perform a fuel injection.

If the piezo actuator 180 is charged via the electrical terminal 190 and thus the length of the piezo actuator 180 is increased, the piezo actuator 180 exerts a force on the control piston 340 via the leakage pin 420, which force causes the control piston 340 to move in the direction of the spring chamber 320. Thus, the volume of the first control chamber 380 increases, whereby the pressure in the first control chamber 380 decreases. Said pressure drop in the first control chamber 380 is transmitted via the connecting bores 540, 560 in the control piston 340 directly to the face side 520 of the nozzle needle 460, and thus to the second control chamber 500. If the pressure drop in the second control chamber 500 falls below a particular value, the closing force acting on the nozzle needle 460 consequently decreases. The high pressure of the high-pressure region 130, which continues to act on the lower end of the nozzle needle 460, consequently effects a movement of the nozzle needle 460 upward in the direction of the second control chamber 500. Thus, the piezo injector 100 is opened in order to inject fuel.

The ratio of the diameter of the control piston 340, and thus of the diameter of the first control chamber 380, to the upper nozzle needle diameter at its face side 520, and thus to the diameter of the second control chamber 500, defines the transmission ratio of piezo actuator stroke to nozzle needle stroke.

After the opening of the nozzle needle 460, the stroke of the nozzle needle 460 can be controlled by way of a variation of the length of the piezo actuator 180. The length of the piezo actuator 180 can in turn be varied by way of a variation of the energy supplied to the piezo actuator 180 via the electrical terminal.

If the piezo actuator 180 is subsequently discharged and thus shortened, the rail pressure acting in the spring chamber 320, together with the likewise acting force of the control sleeve spring 300 on the control piston 340, effect a movement of said control piston in the direction back toward its initial position, that is to say in the direction of the first control chamber 380. Thus, the pressure in the first control chamber 380 increases, and via the connecting bores 540, 560 between the first control chamber 380 and the second control chamber 500, the pressure in the second control chamber 500 also increases. This results in a return movement of the nozzle needle 460 to the lower end of the lower part of the piezo injector 100, whereby the piezo injector 100 is closed, and the injection of fuel is ended.

The spring force exerted on the control piston 340 by the control piston spring 300 ensures that, in the closed state of the piezo injector 100, the control piston 340 always bears against the leakage pin 420, and the drive formed by the piezo actuator 180, the leakage pin 420 and the control piston 340 is free from play. This has the result that fluctuating thermal boundary conditions, changes in length of the piezo actuator 180 and wear phenomena in the contact regions do not have a significant influence on the injection quantities output by the piezo injector 100.

The leakage pin 420 is fitted into the leakage pin bore 400 with a first pairing clearance 640. Owing to the first pairing clearance 640, a first leakage 645 out of the first control chamber 380 takes place along the leakage pin 420 in a region of the piezo injector 100 arranged above the leakage pin 420, from where the first leakage 645 can escape via the leakage port 160. Owing to the high pressure prevailing in the first control chamber 380, the first pairing clearance 640 must be selected to be small in order to realize a small first leakage 645. In this case, the first pairing clearance is less than 3 μm, particularly preferably approximately 1 μm.

The control piston 340 is fitted into the control sleeve 220 with a second pairing clearance 660. If the pressure in the first control chamber 380 is lower than the pressure in the spring chamber 320, the second pairing clearance 660 results in a second leakage 665 from the spring chamber 320 along the control piston 340 into the first control chamber 380. The second pairing clearance 660 between the control piston 340 and the control sleeve 220 is preferably between 3 and 10 μm, particularly preferably between 4 and 8 μm, in order to permit an adequate second leakage 665.

The nozzle needle 460 is fitted by way of its upper part 480 into the cylindrical bore 440 in the control piston 340 with a third pairing clearance 680. If the pressure in the second control chamber 500 is lower than the pressure in the spring chamber 320, a third leakage 685 out of the spring chamber 320 into the second control chamber 500 is possible along the spring 600 and along the nozzle needle 460 through the third pairing clearance 680. The third pairing clearance 680 is preferably between 3 μm and 10 μm, particularly preferably between 4 μm and 8 μm.

In the closed state of the piezo injector 100, the first leakage 645 along the leakage pin 420 results in an outflow of fuel out of the first control chamber 380. In order that said flow of fuel out of the first control chamber 380 does not lead to a pressure drop in the first control chamber 380, which would result in an inadvertent opening of the nozzle needle 460, the fuel loss resulting from the first leakage 645 must be compensated by way of the second leakage 665 and the third leakage 685. Consequently, the sum of the second leakage 665 and the third leakage 685 must be at least as great as the first leakage 645.

In the open state of the nozzle needle 460 and thus of the piezo injector 100, the second leakage 665 and the third leakage 685 result in a flow of fuel into the first control chamber 380 and into the second control chamber 500. The inflow of fuel effects an increase in pressure in the first control chamber 380 and in the second control chamber 500. The increase in pressure must however be small enough as not to result in an inadvertent premature closure of the nozzle needle 460 and thus of the piezo injector 100.

The second leakage 665 and the third leakage 685 are also necessary in order to prevent an undesired opening of the nozzle needle 460 in the presence of very steep pressure gradients in the high-pressure region.

What is claimed is:

1. A piezo injector, comprising:

an injector body;

an actuator chamber formed in the injector body;

a piezo actuator comprising a fully active piezo stack arranged in the actuator chamber;

a nozzle body downstream of the injector body;

a control piston bore formed in the nozzle body, a control sleeve arranged in the control piston bore, a control piston arranged in the control sleeve, wherein a first face side of the control sleeve facing toward the piezo actuator sealingly adjoins an intermediate plate, wherein the control piston has a first face side, wherein the first face side of the control piston facing toward the piezo actuator and the first face side of the control sleeve facing toward the piezo actuator define a first control chamber, a nozzle needle with a second face side, wherein the nozzle needle is guided displaceably in a central, cylindrical bore in the control piston, wherein the central bore in the control piston and the second face side of the nozzle needle define a second control chamber, at least one connecting bore formed in the control piston and extending between the first control chamber and the second control chamber, to transmit a change in pressure between the first and the second control chamber, a leakage pin arranged between the piezo actuator and the first face side of the control piston in a leakage pin bore in the intermediate plate, the leakage pin configured to transmit an actuator stroke directly to the control piston, a spring chamber located at an end of the control piston and of the control sleeve facing away from the first control chamber and, a control sleeve spring arranged in the spring chamber, the control sleeve spring forcing the control sleeve into abutment against the intermediate plate.

2. The piezo injector of claim 1, wherein:

a first leakage out of the first control chamber is permitted, a second leakage out of a high-pressure region into the first control chamber is permitted, a third leakage out of the high-pressure region into the second control chamber is permitted, wherein a sum of the second leakage and the third leakage is at least as great as the first leakage, and wherein a sum of the second leakage and the third leakage is sufficiently small that, when the nozzle needle is open, a pressure increase effected in the second control chamber by the second and the third leakage does not lead to a closure of the nozzle needle.

3. The piezo injector of claim 1, wherein the piezo injector has a high-pressure bore connected to the high-pressure region that is connected to the spring chamber.

4. The piezo injector of claim 1, comprising a control piston spring arranged in the spring chamber, wherein the control piston spring forces the control piston into abutment against the leakage pin with a force acting in a direction of the first control chamber.

5. The piezo injector of claim 1, comprising a first pairing clearance between the leakage pin and the leakage pin bore, wherein the first pairing clearance permits the first leakage, and wherein the first pairing clearance is less than 2 μm.

6. The piezo injector of claim 1, comprising a second pairing clearance between the control piston and the control sleeve, wherein the second pairing clearance permits the second leakage, and wherein the second pairing clearance is between 4 μm and 8 μm.

7. The piezo injector of claim 1, comprising a third pairing clearance between the nozzle needle and the control piston, wherein the third pairing clearance permits the third leakage, and wherein the third pairing clearance is between 2 μm and 8 μm.

8. An internal combustion engine, comprising:

a plurality of piezo injectors for injecting fuel, each piezo injector comprising:

an injector body;

an actuator chamber formed in the injector body;

a piezo actuator comprising a fully active piezo stack arranged in the actuator chamber;

a nozzle body downstream of the injector body;

a control piston bore formed in the nozzle body, a control sleeve arranged in the control piston bore, a control piston arranged in the control sleeve, wherein a first face side of the control sleeve facing toward the piezo actuator sealingly adjoins an intermediate plate, wherein the control piston has a first face side, wherein the first face side of the control piston facing toward the piezo actuator and the first face side of the control sleeve facing toward the piezo actuator define a first control chamber, a nozzle needle with a second face side, wherein the nozzle needle is guided displaceably in a central, cylindrical bore in the control piston, wherein the central bore in the control piston and the second face side of the nozzle needle define a second control chamber, at least one connecting bore formed in the control piston and extending between the first control chamber and the second control chamber, to transmit a change in pressure between the first and the second control chamber, a leakage pin arranged between the piezo actuator and the first face side of the control piston in a leakage pin bore in the intermediate plate, the leakage pin configured to transmit an actuator stroke directly to the control piston, a spring chamber located at an end of the control piston and of the control sleeve facing away from the first control chamber and, a control sleeve spring arranged in the spring chamber, the control sleeve spring forcing the control sleeve into abutment against the intermediate plate.

9. The internal combustion engine of claim 8, wherein, for each piezo injector:

a first leakage out of the first control chamber is permitted, a second leakage out of a high-pressure region into the first control chamber is permitted, a third leakage out of the high-pressure region into the second control chamber is permitted, wherein a sum of the second leakage and the third leakage is at least as great as the first leakage, and wherein a sum of the second leakage and the third leakage is sufficiently small that, when the nozzle needle is open, a pressure increase effected in the second control chamber by the second and the third leakage does not lead to a closure of the nozzle needle.

10. The internal combustion engine of claim 8, wherein each piezo injector has a high-pressure bore connected to the high-pressure region that is connected to the spring chamber.

11. The internal combustion engine of claim 8, wherein each piezo injector comprises a first pairing clearance between the leakage pin and the leakage pin bore, wherein the first pairing clearance permits the first leakage, and wherein the first pairing clearance is less than 2 μm.

12. The internal combustion engine of claim 8, wherein each piezo injector comprises a second pairing clearance between the control piston and the control sleeve, wherein the second pairing clearance permits the second leakage, and wherein the second pairing clearance is between 4 μm and 8 μm.

13. The internal combustion engine of claim 8, wherein each piezo injector comprises a third pairing clearance between the nozzle needle and the control piston, wherein the third pairing clearance permits the third leakage, and wherein the third pairing clearance is between 2 μm and 8 μm.

14. The internal combustion engine of claim 8, wherein each piezo injector comprises a control piston spring arranged in the spring chamber, wherein the control piston spring forces the control piston into abutment against the leakage pin with a force acting in a direction of the first control chamber.

* * * * *